US005139039A

United States Patent [19]

Yates

[11] Patent Number: 5,139,039

[45] Date of Patent: Aug. 18, 1992

[54] APPARATUS FOR COUNTERFLOW SPRAY RINSING WITHIN A PLATING BARREL

[76] Inventor: William Yates, 847 S. Sapphire La., Anaheim Hills, Calif. 92807

[21] Appl. No.: 764,832

[22] Filed: Sep. 24, 1991

[51] Int. Cl.[5] ..... B08B 3/06

[52] U.S. Cl. ..... 134/95.1; 134/155; 134/186; 134/153; 285/9.1

[58] Field of Search ..... 134/94, 99, 95, 96, 134/155, 186, 148, 153, 157; 285/9.1

[56] References Cited

U.S. PATENT DOCUMENTS

| | | | |
|---|---|---|---|
| 2,558,628 | 6/1951 | Redin | 134/99 X |
| 2,967,120 | 1/1961 | Chaney | 134/99 X |
| 3,441,035 | 4/1969 | Edwards | 134/103 |
| 3,734,108 | 5/1973 | Almegard et al. | 134/103 X |
| 3,916,937 | 11/1975 | Nystrom | 134/99 X |
| 4,358,470 | 11/1982 | Rasmussen | 134/95 X |
| 4,635,666 | 1/1987 | Daley et al. | 134/95 X |
| 4,738,272 | 4/1988 | McConnell | 134/95 X |
| 4,770,196 | 9/1988 | Osswald | 134/94 X |

*Primary Examiner*—Frankie L. Stinson
*Attorney, Agent, or Firm*—Francis X. LoJacono

[57] ABSTRACT

This invention relates to an apparatus that provides, in combination, a multi-spray counterflow rinse system that is interconnected to a plating barrel which includes an internal spray nozzle so as to spray rinse a multiplicity of chemically treated workpieces which are supported within the plating barrel. The plating barrel is rotatably carried by a superstructure from one process station to another so as to be positioned within a single in-line rinse tank that is employed during the steps of an electroplating process. The invention includes two embodiments of a self-aligning coupling device defined by first and second coupling members that are interposed in a rinse-solution supply line. One coupling member is secured to the superstructure and the other coupling member is mounted to the rinse tank, whereby the two coupling members are coupled together as the superstructure and barrel are lowered into the rinse tank for the rinsing process.

22 Claims, 5 Drawing Sheets

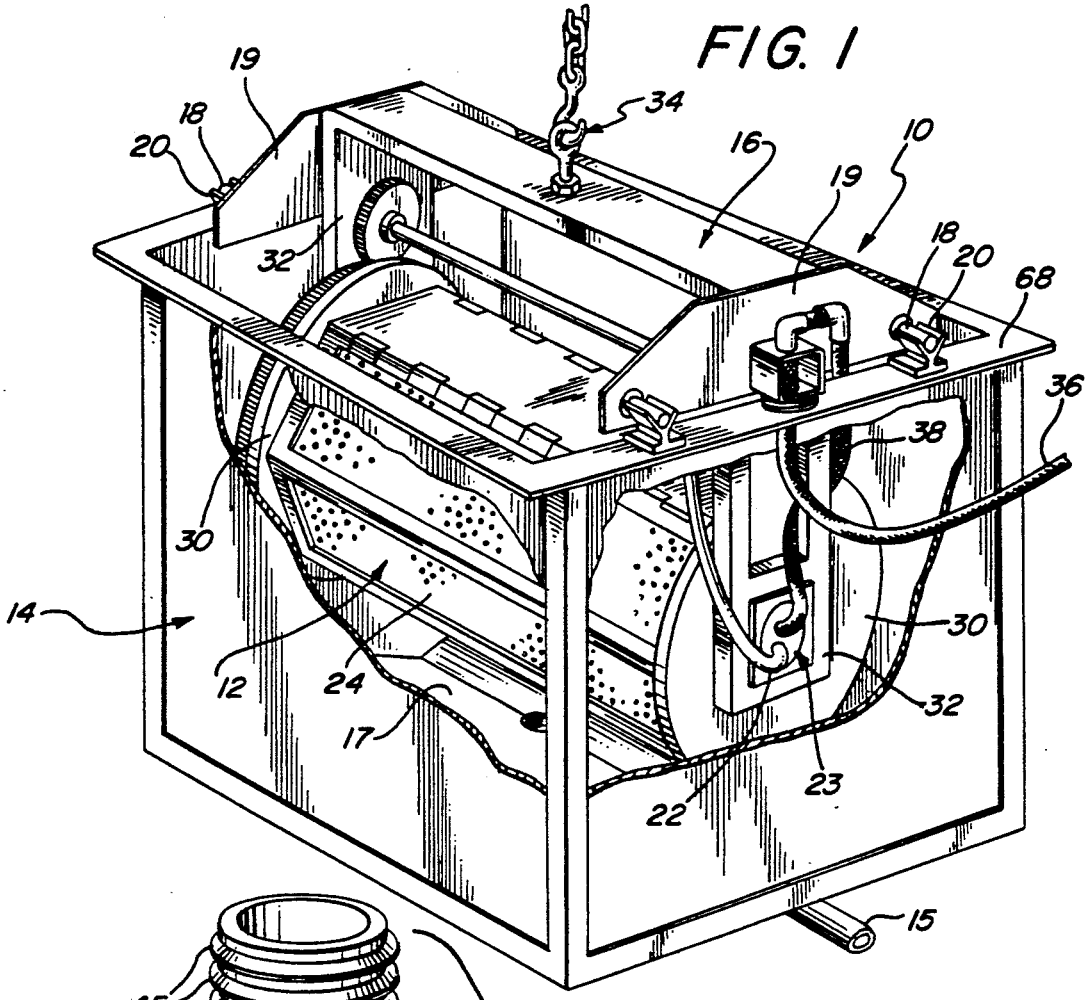
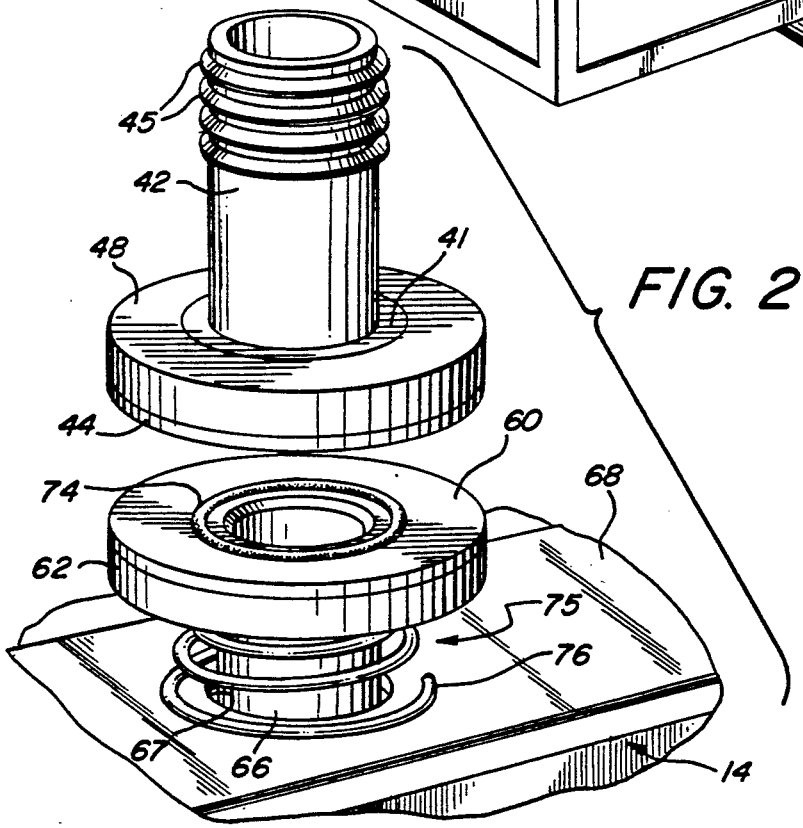
FIG. 2

APPARATUS FOR COUNTERFLOW SPRAY RINSING WITHIN A PLATING BARREL

BACKGROUND OF THE INVENTION

1. Field of the Invention

This invention relates generally to the rinsing or cleaning of chemically treated articles or workpieces, and more particularly to an apparatus for counterflow spray rinsing chemically treated workpieces that are supported within a plating barrel. The rinsing of the workpieces is provided by mens sequential counterflow spraying internally of the barrel, wherein only a single rinse tank is used during the rinsing steps in an electroplating process.

2. Description of the Prior Art

As is well known in the art, various problems and difficulties are encountered in providing suitable and efficient water-rinsing means for rinsing or cleaning of chemically treated articles or workpieces, more specifically workpieces that are supported in a rotatable process barrel. Rinsing of workpieces is generally required after they have been chemically or similarly treated by one of several processes whereby workpieces or articles are cleaned to prevent staining or to prevent the contamination of any sequential processes that might be necessary. Rinsing is generally done by placing the barrel with treated parts in a tank of running water or rinse solution, or sequentially dipping the parts in several tanks. However, sprays using water-rinsing solutions have been utilized for a rinsing method wherein a single workpiece is being processed. Generally, in such spray methods several rinse stations are sequentially mployed. Sprays have also been utilized in combination with flooded rinse tanks.

The combination using both the flooded tanks and sprays is advocate by H. L. Pinkerton and A. Kenneth Graham in their chapter on rinsing in "Electroplating Engineering Handbook", third edition, edited by a A. Kenneth Graham, 1971 (Library of Congress Catalog Card No. 75-12904), where they stated:

"Water Economy

Several means for achieving economy of water have already been mentioned:

(1) Multiple counter-current rinsing.

(2) Spray rinsing.

(3) Spray-and-dip rinsing.

Additional water may be saved if sprays are fed by water pumped from a succeeding rinse tank."

However, there has not been established a spray-rinse system that has been successfully employed for rinsing chemically treated workpiece that are supported within a rotatable plating barrel, as herein disclosed.

It shold be further noted that Joseph B. and Arthur S. Kushner state is their book "Water and Waste Control for the Plating Shop", dated 1972, on page 213:

"Engineering Appendix"

TANK AND SPRAY COMBINATIONS

Where space is limited, tank and spray combinations offer many advantges. Indeed they offer advantages even where space is not limited. These combinations are excellent with most rack rinsing. They are not of much value in barrel rinsing."

At present the only systems known to the applicant are those which are disclosed as follows:

In Electroplating Engineering Handbook (4th Edition) Chapter 24, on BARRELS by William H. Jackson and A. Kenneth Graham, page 583, there is disclosed in FIG. 10 a cross-sectional view of a perforated horizontal plating barrel with an external pump forcing solution through the cylinder into the barrel. However, this does not actually disclose a spray system and is used as recirculating device, as the barrel is required to be substantially submerged in the solution stored in the tank. The solution from the tank is merely pumped from the tank back into the tank through the barrel in a circulating manner.

The concept of a spray system in conjunction with a barrel is disclosed in U.S. Pat. No. 3,945,388 to Chester G. Clark, APPARATUS FOR COUNTERFLOW RINSING OF WORKPIECES. However, the spray system that is disclosed therein teaches the use of spray heads which are to be mounted over the open portion of an oscillation barrel to spray solution over the workpieces contained within. This system does not provide a method or a means to allow for direct internal spraying of the workpieces in a continuously rotating barrel.

Thus, it is important to not that the object of the above is to provide an adequate job of rinsing by diluting the process residue left on the workpiece to the point where it is no longer objectionable with the least amount of water or rinsing solution.

To obtain a rinsing or dilution ratio of 10,000:1, where the production of one hour's processing carries over one gallon of residue into a rinsing tank, 10,000 gallons of water or rinsing solution flow is required over the same hour. To obtain the same 10,000:1 dilution ratio with two rinse tanks, where the rinsing solution is introduced into the second rinse tank—then overflowed to the first rinse tank—only 100 gallons of rinsing solution is required. This is because the dilution ratio is about 100:1 in each tank; therefore, 100:1 $\times$100:1=10,000:1. Carrying this principle further, three counterflowing rinses require 22 gallons, and four rinses require only 10 gallons.

However, to conserve water or rinsing solution by using this technique, a plurality of immersion rinsing tanks and/or spray stations are required within the processing sequence. Utilizing the space for rinse tanks is often costly; and in the case of automated process lines designed before water conservation became a concern, such space is non-existent.

There is also disclosed in U.S. Pat. No. 1,916,465, issued to G. L. Dawson, a barrel that incudes an axial tube provided with perforatins and is connected with an inlet pipe. The inlet pipe is asapted to admit electrolyte to the tube which passes through the perforations into the interior of the drum so as to replace the more or less spent electrolyte in the drum. The pipe is connected to the discharge side of a pump whose suction side has a pipe connected thereto, the pipe being extended downward into the electrolyte in the tank. The pump is arranged to draw up the electrolyte from the tank and pump through the central tube into the interior of the drum.

In a well planned electroplating line, each process tank will be followed by three counterflowing rinses to prevent the contamination of subsequent processes.

The following example shows a typical nickel-chrome plating line, wherein three rinses after each process are required:

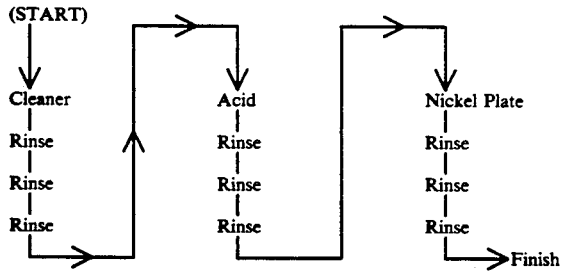

The above list consists of a Cleaner, Acid, and Nickel Plate process; each is followed by three counterflowing rinses. Accordingly, this particular process requires 12 tanks. Each set of three counterflowing rinses can use 100 gallons of water per hour to achieve a rinse ratio of 1,000,000:1 when rinsing one gallon of process residue. (100×100×100=1,000,000). The three sets of rinses will use a total of 300 gallons per hour.

SUMMARY AND OBJECTS OF THE INVENTION

Accordingly, it is an object of the present invention to provide a method and apparatus for multiple counterflow spray rinsing of a multiplicity of workpieces that are supported within a plating barrel, wherein the barrel and the superstructure thereof are removably positioned in a single multi-rinse station (tank). The apparatus comprises the combination of a counterflow spray system which is adapted to be removable interconnected to the barrel for communication with a spray nozzle defined by a pipe or tube that is internally positioned along the horizontal axis within a suitable plating barrel. The spray nozzle is connected at one end to a flexible inlet hose that is movably supported to the superstructure that carries the barrel. This inlet hose provides for rinse solution to be sequentially sprayed in the barrel when it is interconnected to a solution-supply hose that forms part of the counterflow spray system.

The interconnecting of the inlet hose and the supply hose is provided by a floating coupling device, and in two different arrangements thereof are discloed herein. One arrangement comprises a pair of magneticlaly attracted coupling plates or discs, wherein one of the plates incudes a seal. Each magnetic plate or disc is secured to the oppositely positioned hose whereby the coupling plates engage each other as the barrel is lowered into the rinse tank or station. Thus, one cupling plate is movably supported on one side of the superstructure. the other coupling plate is movably mounted to the outer edge of the rinse tank.

Still another object of the invention is to provide an apparatus and method for spray rinsing a multiplicity of workpieces within a plating barrel, wherein the second arrangement of a coupling device includes a free-floating female coupling member and a male coupling member, the female coupling member being formed with a conical receiving cup member adapted to receiver the male member which includes a sealing ring for engagement within the cup member.

Another object of the present invention is to provide and apparatus of this character wherein only a single rinse tank or station is required as provided by a unique multiple counterflow rinsing process. This process is designed to obtain the saving of water heretofore not found in the art. The following is an example of the multiple counterflowing rinse system having a single rinse station when employed in a nickel plating line as compared to the heretofore described nickel plating line having three rinses after each subsequent process:

(START)
Cleaner
Rinse with Multiple Spray Rinser (7 counterflow sprays)
Acid
Rinse with Multiple Spray Rinser
Nickel Plate
Rinse with Multiple Spray Rinser In this example, the same three processes are each followed by the use of one rinse that has the "multiple spray rinse" producing seven counterflow sprays. Here, each set of sprays can use 10 gallons per hour to rinse off one gallon of residue. Hence, the rinse ration is 10 million to 1 using 10 gallons of water per hour (10×10×10×10×10×10×10=10,000,000)

The net results are two fold, these being the unique use of a single rinse tank together with a plating barrel having an internally positioned spray-rinse device and the ability to combine a multiple spray-rinse system to achieve a ten-times better rinsing while using one tenth of the amount of water, in half the space. If, for example, this is an automated processing line that uses programmed hoists to move the work loads from tank to tank, the amount of handling of equipment can be greatly reduced. In the case of barrel processing, this invention introduces a spray rinsing, which was impossible with the fully and continuously rotating barrel heretofore.

Environmentally, the advantages of the multiple sprayer are straight forward. It is well known in the processing industry that, when the flow rate of rinse water is reduced to a practical level, all of the rinse water can be returned to the process tank to compensate for evaporative losses. If the natural surfaces evaporation is low, due to a low temperature process, a small evaporator can be added to aid the evaporation of water from the process tank. When all the rinse water is returned to the process tank, all the rinsed-off residue is saved. There is no need for waste treatment, and nothing is discarded.

It is another important object of this invention to provide any number of counterflowing spray rinses using the space in a processing line assigned to a singled rinse tank.

This is accomplished by installing a spray nozzle within a rotatable plating barrel along with its associated components, such as connector fittings, pipes and couplings.

When a plating barrel hving a multiplicity of workpieces or articles enclosed therein is placed in the rinse tank, a small amount of water of rinse solution is pumped (first spray) from a small off-line tank (reservoir #1) to the spray nozzle. This rinse solution impinges onthe articles passing through the perforated walls of the barrel, drops to the bottom of the rinse tank, and is then pumped elsewhere, either to a discard station, draion waste, or to the process tank to compensate for evaporative losses. After most of this solution has been discharged, a second spray from reservoir #1 is used to rinse the articles, this solution being circulated back to reservoir #1.

Next, a first short spray from a second off-line tank (reservoir #2) is provided to dilute the residue on the processed articles within the barrel, the rinse solution being pumped back to reservoir #1. After a short wail, a second spray from reservoir #2 is emplkoyed to rinse the articles, the rinse solution being circulated back to reservoir #2. then, a short spraying from the third off-line tank (reservoir #3) is used. This is returned to reservoir #2. After a short wait, another spraying from reservoir #3 is used and returned to reservoir #3. Following the last spraying from reservoir #3, a final spray is provided by using a fresh solution source, preferably fresh city water. Once sprayed, this fresh water is pumped to reservoir #3, which stores the least contaminated solution.

In the equipment layout for the above description, three reservoirs are used and various pump and/or automatic valve combinations can be employed.

However, it should be further understood that any number of reservoirs can be employed, even though only three reservoirs are shown and disclosed herein. With the use of three reservoirs, the end result is that seven separate sprays are accomplished in each complete rinse cycle, and each spray is progressively cleaner (less contaminated) than the preceding spray.

As an example, if 10 gallons of counterflowing rinse solution are used for each gallon of process solution residue, the resulting dilution would exceed 10,000,000:1.

$(10\times10\times10\times10\times10\times10\times10=10{,}000{,}000)$.

Accordingly, it is still another important object of the present invention to use only 10 gallons of rinse solution of water for every gallon of contaminated residue that is to be removed from the articles enclosed within the barrel for bulk processing.

BRIEF DESCRIPTION OF THE DRAWINGS

Referring more particularly to the accompanying drawings, which are for illustrative purposes only:

FIG. 1 is a pictorial view of a rinse tank, wherein the walls are broken away to show a plating barrel supported therein and having the magnetic coupling device mounted for a rinse cycle;

FIG. 2 is an exploded perspective view of the magnetic coupling device;

DESCRIPTION OF THE PREFERRED EMBODIMENT

Figure 4:
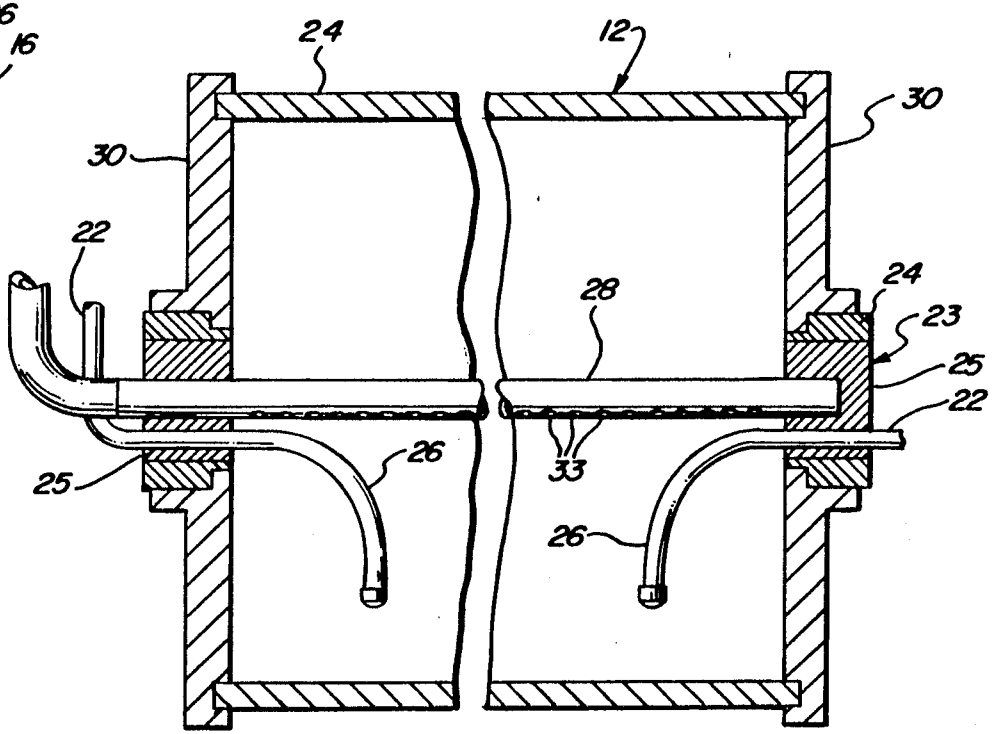
FIG. 4 is a cross-sectional view of a plating barrel, wherein there is mounted the elongated spray nozzle.

Referring more particularly to FIG. 1, there is illustrated an apparatus, generally indicated at 10, for spray rinsing a multiplicity of workpieces or articles (not shown) that are stored within the plating barrel, designated generally at 12. Plating barrel 12, which is used as a carrier for processing in bulk small workpieces, is positioned within a rinse tank 14 that includes a drain outlet 15 mounted in the diverging tank floor 17. The supporting frame structure 16 of the barrel is commonly provided with support pins or lugs 18 that rest in cradle members 20. These pins also make up part of the electrical system necessary to provide electric power for an electroplating treatment which is performed at selected work stations. Two electrical cables 22 are connected to each set of lugs 18 and enter the central hub means 23 to the barrel. The hub means is shown as having a bearing 24, a journal member 25 (see FIG. 4), and dangles therein to define a pair of oppositely disposed electrodes 26. This is a common arrangement. The plating barrel may be of a suitable type that can be adapted to receive a spray nozzle means such as the elongated pipe or tube 28, which is shown journaled within the end walls 30 of the hexagonal-shaped barrel 12. Barrel 12 is rotatably mounted in the depending side leg members 32 and is adapted to rotate or oscillate about its central axis, the central axis being herein defined by spray nozzle 28. However, the spray nozzle is mounted along the central axis of the barrel. As seen in FIG. 4, tube 28 is provided with a plurality of holes 33 that are directed in a relatively downward direction. Side walls 34 are perforated to allow free flow of the processing liquids as well as the rinsing solution as the many parts or workpieces are internally sprayed. It should be noted that the elongated spray nozzle 28 may also be positioned off to one side of the central axis as illustrate in FIG. 7.

Frame structure 16, further includes a substantially horizontal cross beam that interconnects side leg members 32, as shown in FIG. 1 of the drawings. There are various methods of transporting the barrel superstructure from station to station, one being the eye and hook arrangement as illustrated herein at 34.

As previously mentioned, the present invention is particularly suitable for systems that employ a single multi-rinse tank process. That is, after leaving each chemical treating station the barrel is transferred to a single rinse tank represented by rinse tank 14, and then the barrel and its superstructure thereof are lowered into the tank. As the barrel assembly is lowered into tank 14, a coupling means, indicated generally at 35, is automatically coupled in a sealed manner. When this occurs, a rinse-solution supply line 36 is operably connected to an inlet spray line 38 to provide a free flow of rinse solution into the interior of the tank by means of spray nozzle 28. Accordingly, rinse line 36 is connected to a suitable supply means of the rinse solution. The rinse cycle is started by means of a suitable automatic sensing device, not herein disclosed.

Figure 3:
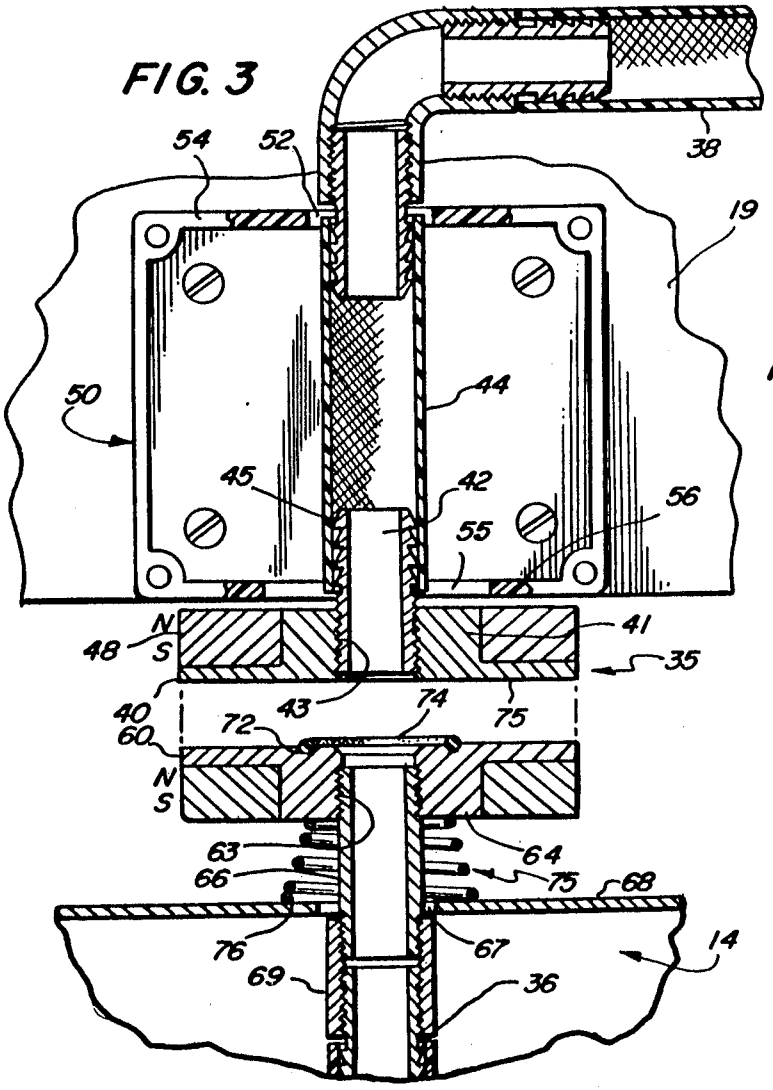
FIG. 3 is an enlarged cross-sectional view of the magnetic coupling device, wherein the two coupling members are separated just prior to being connected.

Coupling means 35 comprises a first coupling disc 40 which is formed having a central boss member 41 that is provided with a threaded bore 43 in which there is mounted an extended neck member 42 defined by a rigid tube. The tube is provided with attaching means in the form of a plurality of annular teeth 45 that are adapted to be force-fitted into a flexible tube or pipe 44, as shown in FIG. 3. Suitable pipe nipples and an elbow are connected to the opposite end of flexible tube 44 and to inlet spray hose 38. Thus, spray hose 38 allows fluid to flow between the first coupling disc 40 and nozzle 28 horizontally positioned in barrel 12. A doughnut-shaped magnet 48 is positioned over boss member 41 so as to rest on the outer side of disc 40 as seen in FIG. 3. A housing 50 is affixed to the lug plate 19 of frame structure 16. Housing 50 is formed having a pair of vertically aligned holes, wherein hole 52 being located in the upper wall 54 and hole 55 being located in the bottom wall 56. This arrangement allows for freedom of movement of the coupling disc 40 and the adjacent tube 44 which is positioned within housing 50, whereby the disc assembly is limited in movement yet allows disc 40 to magnetically self-align with the lower positioned disc 60. Disc 60 is formed similar to disc 40, so that a second magnet 62 is located around boss 64. A tubular neck member 66 is inserted into threaded bore 63 and passes through hole 67 formed in the peripheral flange 68 of spray rinse tank 14. Neck 66 is connected to spray-rinse supply line 36 by suitable means such as couple 69, as shown in FIG. 3. Interposed between disc 60 and flange 68 is a biasing means such as spring 70 which retains disc 60 in an extended upright position so as to be readily self-aligned magnetically to first disc 40 when it is lowered with barrel frame structure 16. In order to provide a sealing means between the two disc members, one of the disc members is fitted with an "O"-ring seal. Thus, an annular channel 72 is shown formed in disc 60 having an "O"-ring 74 mounted therein for engagement with the outer flat surface 75 of disc 40. It should be noted at this time that, even though a pair of magnets are illustrated herein, it is contemplated that only one magnet is necessary if an oppositely positioned disc is formed using suitable magnetically attractive metal.

Accordingly, as the barrel is lowered into the rinse tank 14 the two disc members 40 and 60 are aligned by their magnetic attraction to each other and engage so as to be sealed by means of "O"-ring 74. To protect both coupling disc members, disc member 60 is provided with a shock-absorbing means, generally indicated at 75, defined by a coil spring member 76 that is interposed between the bottom of disc member 60 and tank flange 68. Rinse solution is then allowed to pass through lines 36 and 38, as previously described. When the spray rinsing steps are completed frame structure 16 is raised from rinse tank 14, thereby separating the two disc members. The workpieces are then transported back for further processing or are removed from the barrel in a fully rinsed condition.

Figure 6:
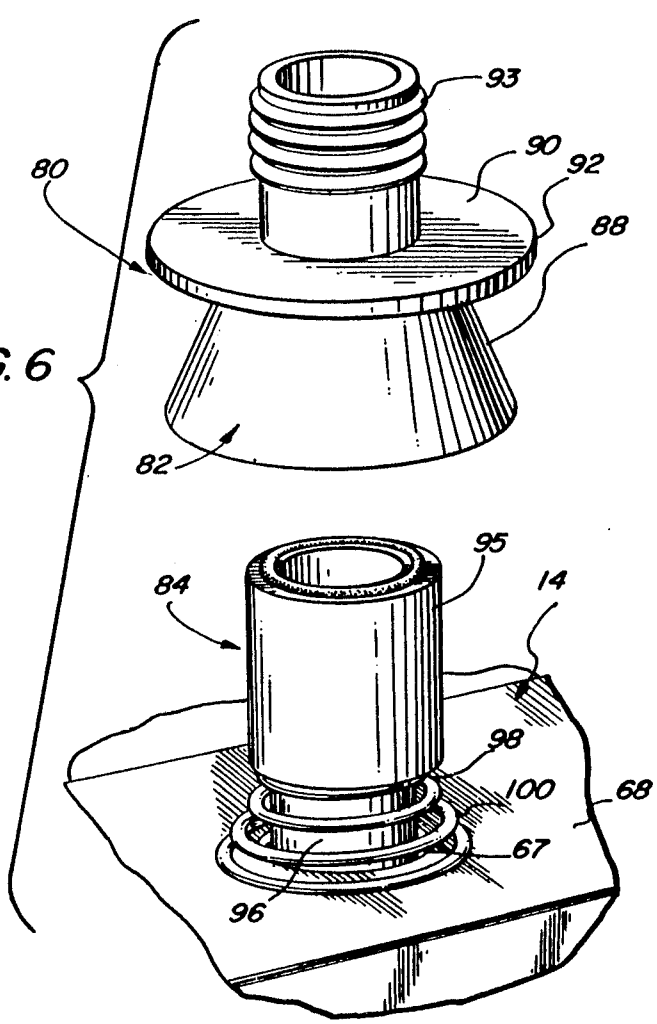
FIG. 6 is an exploded perspective view thereof.
Figure 5:
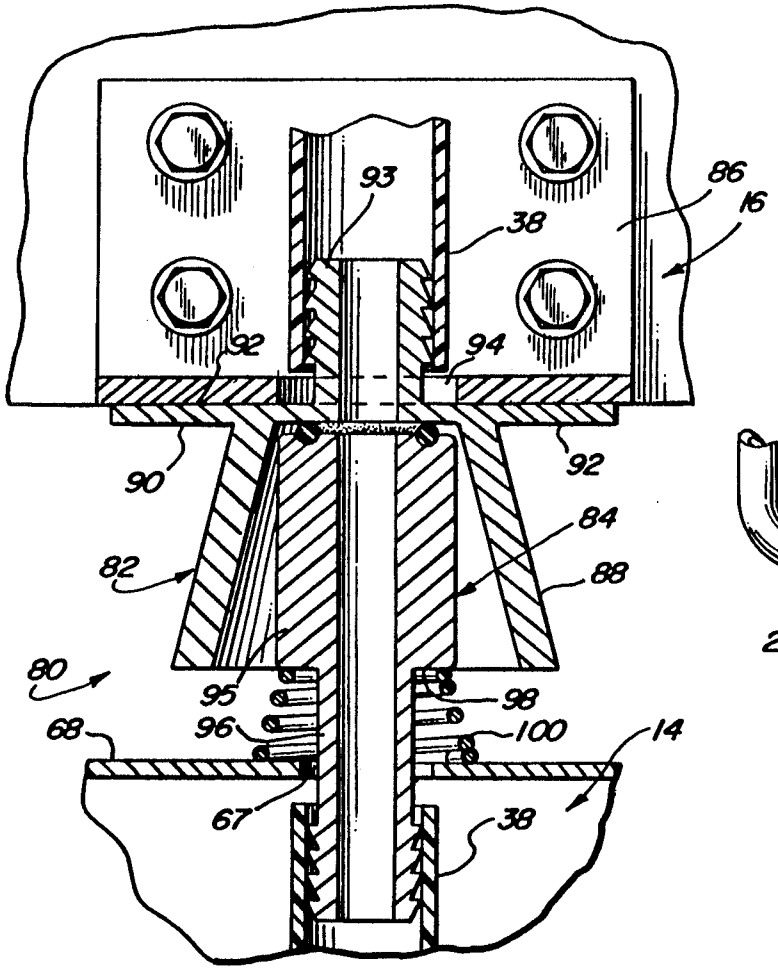
FIG. 5 is an enlarged cross-sectional view of the alternative embodiment of the coupling device of the present invention.

A second embodiment of the present invention is shown in FIGS. 5 and 6, wherein the coupling device, is designated at 80 has a first coupling member 82 and a second coupling member 84. Coupling member 82 will hereinafter be referred to as the female member and coupling member 84 will be referred to as the male member. Female member 82 is connected to inlet spray line 38 and male member 84 is connected to inlet line 36 in a similar manner to that described in the first embodiment 35. This particular embodiment will be described as having the female member mounted and freely supported in bracket 86, which is attached to the carrier frame structure 16, and the male member 84 freely mounted to the rinse tank 14. However, it should be noted that the positioning of the female and male members can be readily reversed without departing from the proper operation of the invention.

Female member 82 is formed having a cup or a truncated conical shaped main body 88 which is defined by an annular plate member 90 which is provided with an upper wall for body 88 and an annular flange 92. Extending upwardly from plate 90 is nipple member 93 which is adapted with means to secure the nipple within supply line 38, as illustrated in FIG. 5. Nipple 93 and hose 38 are positioned through hole 94 to bracket 86, whereby coupling member 82 is allowed to freely move within hole 94 for ease of alignment when connecting with male coupling member 84, which is also freely mounted in hole 67 formed in flange 68 of rinse tank 14. Male member 84 is formed having a coupling head member 95 and a depending neck member 96, the end of which is adapted to be secured to inlet hose 38. Head member 95 is formed having a shoulder 98 so as to provide an engaging surface for spring member 100 which is interposed between head member 95 and flange 68.

Accordingly, as the barrel and the carrier frame structure are lowered into rinse tank 14, conical cup 88 will be positioned to receive head member 95. The conical shape of cup 88 will guide head member 95 to align its passage 101 with passage 102 of nipple 93. The top surface of head 95 is formed with an annular channel 104 in which is positioned a sealing "O"-ring 106 that engages plate 90. The weight of carrier structure 16 provides enough force to maintain a positive seal between the female member and the male member.

Figure 7:
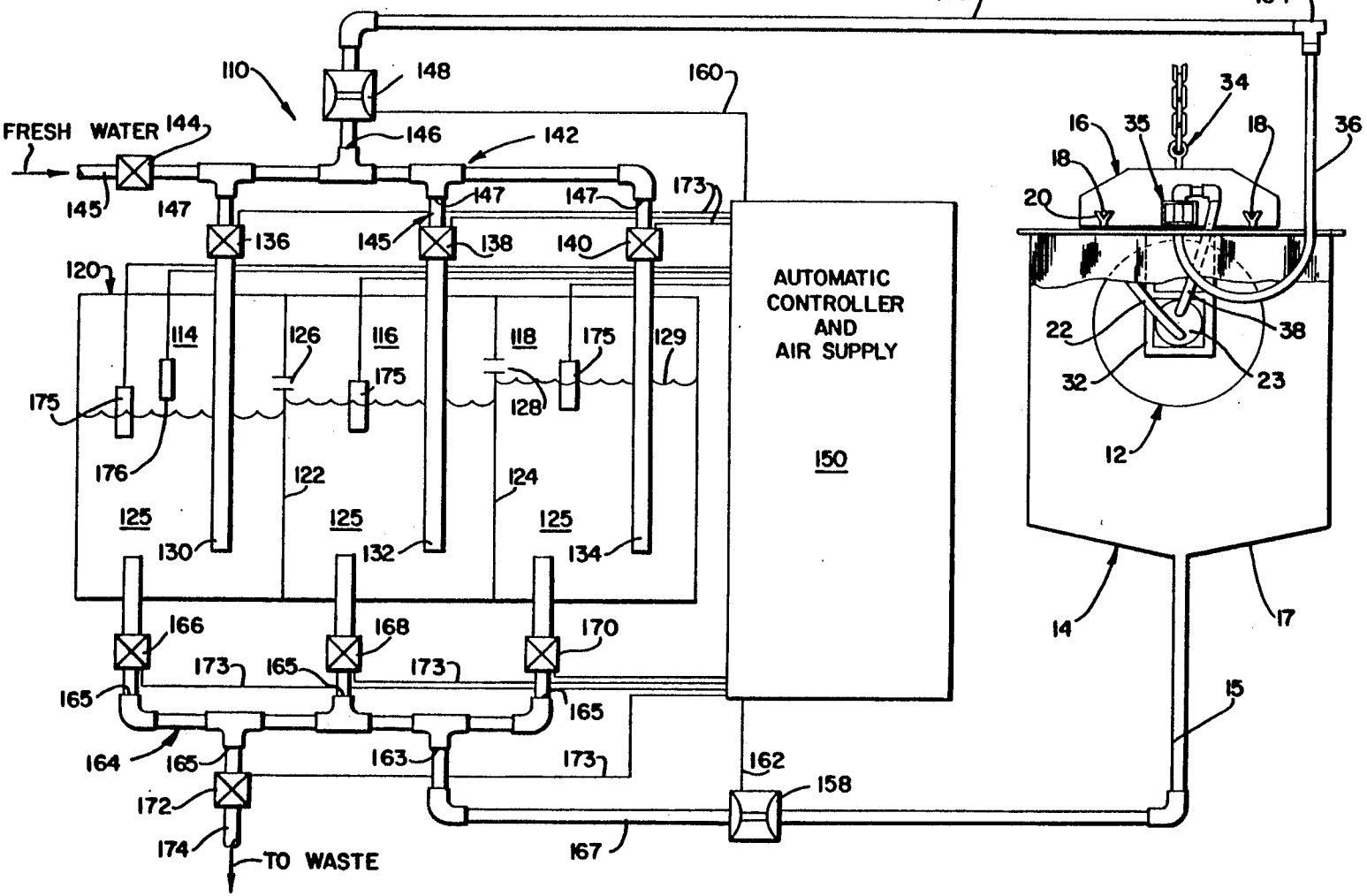
FIG. 7 is a diagrammatic view showing an example of a counterflow seven-rinse system using a rinse tank in which a plating barrel is positioned during the rinsing process.

Referring more particularly to FIG. 7, there is shown a fluid-circulating system, generally indicated at 110, that includes a new method of circulating fluid for multiple counterflow rinsing of chemically treated articles or workpieces, which includes spray tank 14, and reservoirs 114, 116, and 118 that are shown formed in a single unit, indicated generally at 120. Although, three reservoirs are shown and described herein it should be well understood that any number of reservoirs may be suitably employed so as to correspond to a particular counterflow rinse system. That is, several reservoirs may be added or subtracted as need be.

Accordingly, the following is a description of the present invention having the embodiment that includes three reservoirs 114, 116, and 118 in which water or a selective type of rinse solution is stored for operating the process of the present invention. For simplicity, lowering cost, and saving space, reserviors 114, 116, and 118 are shown formed as a single unit 120 having walls 122 and 124.

However, each reservoir may be made as an individual tank, when required. Each storage tank or reservoir is provided with a different strength of rinse solution 125. Hence, each successive tank of reservoir 114, 116, and 118 holds progressively cleaner or less contaminated rinse solution 125. Due to the sequential arrangement and steps of the process, which will hereinafter be described in more detail, the degree of contamination of the rinse solution in each reservoir will remain substantially the same throughout the rinsing operation. Preferably, in order to save space, reservoirs 114, 116, and 118 are positioned in a contiguous arrangement whereby reservoir 118 communicates with reservoir 116 and reservoir 116 communicates with reservoir 114. The communication means is defined by overflow pipe connectors 126 and 128 mounted in respective walls 126 and 128, with overflow pipe connector 126 being located sequentially lower than pipe connector 128, and both connectors being positioned above operating water line 129 of the reservoirs, as seen in FIG. 7. This allows for diluted rinse solution to flow from each succeeding reservoir as needed. Accordingly, the most diluted rinse solution is stored in reservoir 118, and the most contaminated rinse solution is stored in reservoir 114.

Each reservoir is provided with a discharge-flow outlet pipe; that is, reservoir 114 is provided with discharge pipe 130, reservoir 116 with discharge pipe 132, and reservoir 118 is provided with discharge pipe 134. Pipes 130, 132 and 134 are each connected to a valve means 136, 138 and 140, respectively. The valve means may be of any suitable type, but is preferably a pneumatically operated one such as a double-acting pneumatic valve produced by Ryan Herco. Valve means 136, 138 and 140 will hereinafter be referred to as discharge valves since they are disposed between their respective discharge pipes and outlet ports of a discharge manifold, designated generally at 142. A fourth valve 144 is connected to manifold 142 along with the discharge valves. Valve 144 is a fresh water valve and is connected to any suitable fresh water line 145.

Connected to the outlet port 146 of manifold 142 is a spray pump means 148. This pump may be of any suitable type such as an air-powered, double-diaphragm, Marathon ball valve MP04P pump. Thus, it is to be noted that the pumps and valves herein disclosed are of an air-operated type that are operably connected to an air supply means, which also includes an automatic control and air supply means, generally indicated at 150. Pump means 148 is located in discharge pipeline 152 which is provided at its far end with a connecting means, indicated at 154, and positioned over rinse tank 14 so as to spray solution 125 into barrel 12 by means of supply line 15, as illustrated in FIG. 1.

Accordingly, solution 125 is drained into an outlet system which includes drain pipe 15 connected to a second pump means 158. Both pumps 148 and 158 are operated by air supply means 150 through air lines 160 and 162, respectively. Pump 158 is further connected to the inlet port 163 of a return manifold 164 by means of return pipe 167. Attached to the outlet ports 165 of manifold 164 are four additional return valves 166, 170 and 172. Valve 166 is positioned between manifold 164 and reservoir 114; valve 168 is located between manifold 164 and reservoir 116; and valve 170 is positioned between manifold 164 and reservoir 118.

Valve 172 is directed to waste, or to a process tank (not shown) to compensate for evaporation losses. All valves in this illustration are operated by the automatic controller means and air supply means 150, and are connected thereto by air supply lines 173. However, other suitable operating means, such as electric pumps and solonoids can be used.

OPERATION OF THE PROCESS

The following description of the present invention discloses the employment of three reservoirs. However, the process can readily be practiced with any number of reservoirs that would be compatible to a particular process. As examples, a single reservoir or tank provides three counterflow sprays, two reservoirs provide five counterflow sprays, three reservoirs provide seven counterflow sprays, etc.

Figure 8:
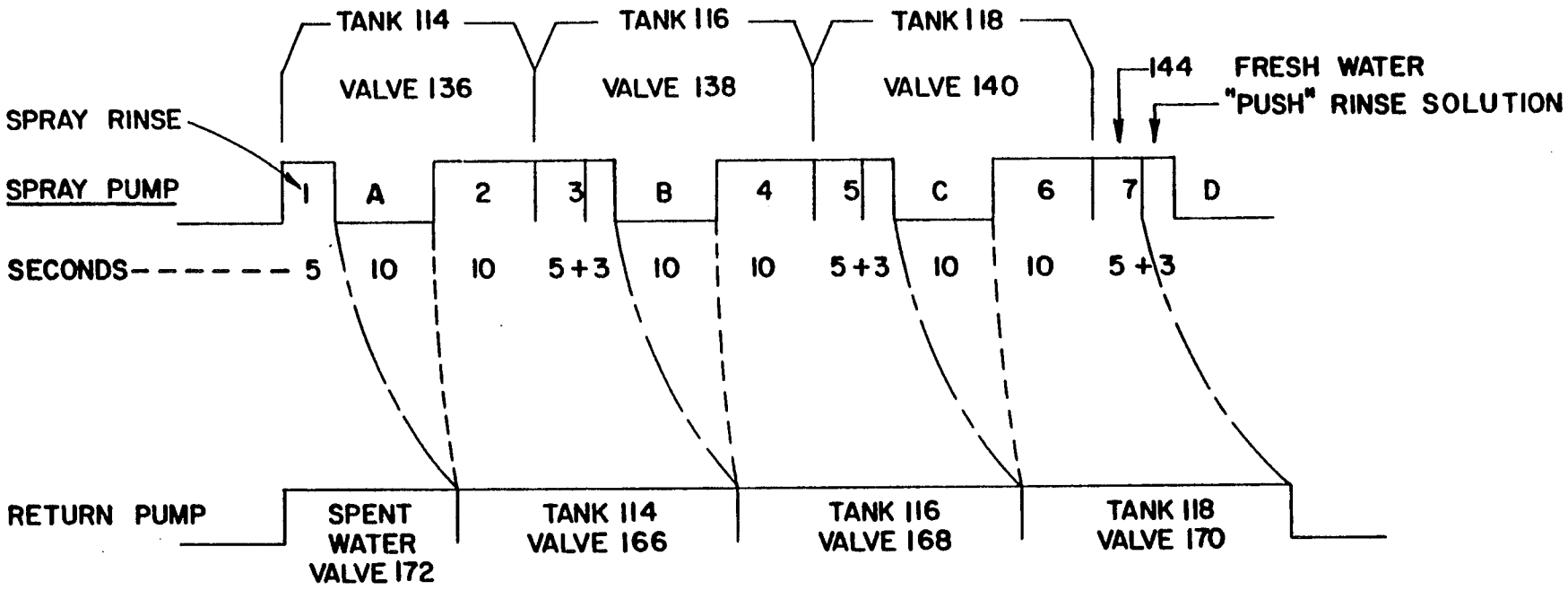
FIG. 8 is an operational chart of the pump and valve programming of the sequential circulating counterflow system.

FIGS. 7 and 8 should be referred to during the reading of the following operational description. The valve operational chart of FIG. 8 includes an upper line indicating the spray pump operation 148 and the lower second line indicates the spray pump operation 158. The upper line includes the "on" and "off" timing of valves 136, 138, 140 and fresh water valve 144 with respect to the operation of the three reservoirs and the seven spray-rinse cycles. The broken lines define the flow of solution between the three tanks 114, 116 and 118 with respect to the valve operation and the seven spray-rinse cycles.

Each time a rinsing process begins, a first (1) spray-rinse cycle starts with solution 125 being pumped from reservoir 114 for five seconds by way of outlet pipe 130. Reservoir 114 has the solution with the highest contamination stored within the three tanks. This solution is drawn and pumped through valve 136 by means of pump 148, and is sprayed by spray means 154 for 5 seconds over workpieces located in barrel 12 which is positioned in rinse tank 14. Solution from rinse tank 14 is then drained (drain cycle A) and pumped by pump 158 through manifold 164, and discharged through open valve 172 as spent solution through outlet line 174 for 10 seconds. It should be understood that at this time all of the other valves are in a closed mode. The spent solution will contain almost all of the residue rinsed off the processed workpieces; thus it is either sent to waste or back to the process tank, as mentioned above for a highly contaminated solution.

Drain cycle A occurs between the first (1) spray rinse and the second (2) spray rinse. This is referred to as a ten-second "OFF" time. That is, valve 136 is closed down until all of the solution for the first spray rinse is drained from rinse tank 14 before valve 138 is opened. The first ten-second "OFF" time (See chart of FIG. 8 at A.) allows enough time for the sprayed solution to be emptied from the spray-rinse tank 14. A second spray-rinse cycle begins and sprays the workpieces or articles located within barrel 12, but this time valve 172 is closed and valves 136 and 166 are now open, allowing the solution from reservoir 114 to return back to reservoir 114. Valve 136 is at this time placed in an open mode for ten seconds which is indicated at (2) in FIG. 8. Then valve 136 is closed to start the third (3) spray rinse cycle with valve 138 being opened for eight seconds (5+3), the last three seconds remaining in the outlet pipes 142, 146 and 152. This allows the first five seconds of solution 125 from reservoir 116 to be returned to reservoir or tank 14. Then the third (3) rinse cycle is closed down; that is, valve 138 is closed (See B in FIG. 8) for ten seconds allowing solution 125 to be drained from rinse tank 14. Valve 138 is then returned to an open mode for ten seconds. At the same time valve 168 is opened to start a fourth (4) spray-rinse cycle, whereby solution from tank 116 is returned back to tank 116. When valve 138 is closed, valve 140 is opened for eight seconds (5+3), allowing solution from tank 118 to flow through spray means 154 for a fifth (5) spray rinse into tank 116. Valve 140 is closed down for a third drain cycle C, allowing solution from rinse tank 14 to completely drain into reservoir 118, again allowing the last three seconds of solution to remain in the pipes between valve 140 and spray means 154.

A sixth (6) spray rinse cycle is started when valve 140 is reopened along with the closing of valve 168 and the opening of valve 170 connected to tank or reservoir 118. Accordingly, solution from tank or reservoir 118 is recycled back to reservoir 118 preceded by the leftover three seconds of solution from tank 116. Again, valve 140 is in an open position for ten seconds and then valve 140 is closed to start the seventh (7) rinse cycle. For the seventh and final rinse cycle of the process, fresh water valve 144 is opened, allowing fresh water to be pumped through spray means 154 whereby fresh water is sprayed over the bulk articles supported in plating barrel 12. This rinse is timed for five seconds and is then closed down. However, it is important to note that, following the closure of valve 144, valve 136 of reservoir 114 is again opened for three seconds. This is done in order to provide three seconds of solution from tank 114 to fill the intervening pipe between valve 136 and spray means 154 so as to provide a "push" rinse for the beginning of the following rinse process of another barrel of workpieces. All of the valves in the system close prior to the starting of another complete rinsing process. This is indicated at D in the operational chart of FIG. 8.

It may thus be seen that the objects of the present invention set forth herein, as well as those made apparent from the foregoing description, are efficiently attained. While preferred embodiments of the invention have been set forth for purpose of disclosure, modifications of the disclosed embodiments of the invention as well as other embodiments thereof may occur to those skilled in the art. Accordingly, the appended claims are intended to cover all embodiments which do not depart from the spirit and scope of the invention.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What I claim is:

1. In combination, an apparatus for counterflow spray rinsing of a multiplicity of chemically treated workpieces that are supported within a plating barrel comprising:

a plating barrel mounted to a carrier superstructure so as to be removably positioned within a rinse-tank structure;

a spray means mounted within said plating barrel, whereby a rinse solution is sprayed within the plating barrel;

a counterflow spray-rinse supply means;

a rinse supply line connected at one end thereof to said counterflow spray-rinse supply means and removably connected at the opposite end thereof to said spray means within said barrel; and a releasable coupling means interposed in said rinse supply line;

a plurality of reservoirs wherein the rinse solution is stored;

a single spray-rinse tank connected so as to communicate with said reservoirs to receive the rinse solution from each of said reservoirs for spray-rinsing the workpieces positioned within said barrel;

a first flow means for discharging the rinse solution from said reservoirs to said barrel in a selective "on"-and-"off" overlapping sequential operation;

means for operating said first and second flow means; and means for automatically controlling the sequential operation of said first and second flow means.

2. The combination as recited in claim 1, wherein said spray means is defined as a nozzle member.

3. The combination as recited in claim 2, wherein said first flow means for discharging the rinse solution comprises:

a plurality of discharge valves, each of said discharge valves being operably connected with said respective reservoirs and said spray means; and wherein one of said discharge valves includes a fresh water valve operably connected to said spray means and positioned in-line with said other discharge valves, said fresh water valve being connected to a water supply means; and a pump means connected to said discharge valves, said fresh water valve and said spray means, whereby said solution and said fresh water are pumped from said reservoirs and said water supply means respectively for spraying the workpieces supported in said barrel in a sequential overlapping order, whereby said solution in said reservoirs is progressively diluted for the sequential spraying of the workpieces to be cleaned followed by a final spray rinse of the fresh water from said supply means.

4. The combination as recited in claim 3, wherein said counterflow rinse supply means includes two reservoirs and three counterflow spray cycles.

5. The combination as recited in claim 4, wherein said counterflow rinse-supply means includes three reservoirs and seven counterflow spray-rinse cycles.

6. The combination as recited in claim 2, wherein said releasable coupling means comprises a first coupling member and a second coupling member, said first coupling member being mounted to the carrier superstructure and said second coupling member being mounted to the rinse tank structure, and including means for aligning said first and second coupling members when they are coupled together.

7. The combination as recited in claim 6, wherein said first and second coupling members are each formed having a substantially flat disc member including a centrally positioned neck member and sealing means mounted on at least one of said coupling members.

8. The combination as recited in claim 6, wherein said spray nozzle comprises an elongated nozzle pipe horizontally mounted and positioned along the central axis of said barrel, whereby one end of said nozzle pipe is connected to one end of an inlet hose of said supply line, and the opposite end of said inlet hose is connected to said first coupling member.

9. The combination as recited in claim 8, wherein said second coupling means is connected to a rinse hose section of said rinse solution supply line.

10. The combination as recited in claim 9, including:

a carrier superstructure, whereby said first and second coupling members are connected when said barrel and said superstructure are lowered in said rinse tank; and a biasing spring interposed between said disc member and said rinse tank.

11. The combination as recited in claim 10, including means for mounting said first coupling member to said carrier superstructure.

12. The combination as recited in claim 11, wherein said alignment means is defined by magnetic disc members of said first and second coupling members.

13. The combination as recited in claim 11, wherein said alignment means comprises a magnet mounted to at least one of said disc members.

14. The combination as recited in claim 6, wherein said first coupling member is formed having a cup member and means to limit the vertical movement thereof, and wherein said second coupling member is formed having a head member to be received within said cup member of said first coupling member.

15. The combination as recited in claim 14, wherein one of said coupling members includes a sealing means to be interposed between said cup member and said head member of said respective coupling members.

16. The combination as recited in claim 15, wherein a spring biasing means is positioned between said head member and the rinse tank.

17. The combination as recited in claim 14, wherein said cup member is defined by a truncated cone, and wherein said limiting means comprises an annular flange.

18. An apparatus for spray-rinsing chemically treated workpieces or articles supported in a bulk processing barrel using a single spray rinse station, wherein the least amount of rinse solution is used in diluting residue left on the treated workpieces, said apparatus comprising:

at least one rinse tank defining a spray station having a spray assembly mounted in a processing barrel that is rotatably mounted to a carrier superstructure, said processing barrel being arranged to receive a multiplicity of workpieces therein and wherein a rinse solution is sprayed over the workpieces;

a plurality of reservoirs having sequentially less contaminated rinse solution stored in each of said reservoirs;

a counterflow means having a discharge flow system including a plurality of rinse cycles and a return flow system, said discharge flow system being attached to said spray assembly in said processing barrel whereby rinse solution is sprayed in sequential overlapping cycles from each reservoir into said processing barrel, and wherein said return flow system communicates between said rinse tank and each of said reservoirs, whereby rinse solution from said spray-rinse tank is returned sequentially to each reservoir in a corresponding overlapping response to the discharging of rinse solution from said reservoirs;

means for supplying fresh rinse solution to a last reservoir having the least contaminated solution stored therein, so as to define a final rinse cycle;

means for controlling and operating the sequential operation of said discharge flow system and said return flow system; an wherein said discharge flow system includes a rinse supply line connected at one end thereof to said reservoirs and removably connected at the opposite end thereof to said spray assembly whereby the rinse spray solution is sprayed throughout said processing barrel;

a releasable coupling means interposed in said rinse supply line, wherein said releasable coupling means comprises a first coupling member and a second coupling member, and wherein said first coupling member is mounted to said carrier superstructure and said second coupling member is mounted to said rinse tank, and including means for aligning said first and second coupling members when said coupling members are coupled together as said superstructure and said processing barrel are lowered into said rinse tank.

19. The apparatus as recited in claim 18, wherein said spray assembly is defined by a nozzle member, and wherein said first and second coupling members are formed having a substantially flat disc member including a centrally positioned neck member, and sealing means mounted on at least one of said coupling members.

20. The apparatus as recited in claim 19, wherein said spray assembly comprises an elongated nozzle horizontally mounted and positioned along the central axis of said processing barrel, whereby one end of said nozzle is connected to one end of a first inlet hose section of said rinse supply line, and the opposite end of said first inlet hose section is connected to said first coupling member, said second coupling member being connected to a second inlet hose section of said rinse supply line.

21. The apparatus as recited in claim 18, wherein said alignment means comprises a magnet mounted to at least one of said disc members.

22. The apparatus as recited in claim 18, wherein said spray assembly is defined by an elongate nozzle member which extends horizontally within said processing barrel, and wherein said first coupling member is formed having a truncated cup member and means to limit the vertical movement thereof, and wherein said second coupling member is formed having a head member to be received within said cup member of said first coupling member.

* * * * *